US009839908B2

(12) United States Patent
Aizenberg et al.

(10) Patent No.: US 9,839,908 B2
(45) Date of Patent: Dec. 12, 2017

(54) MICRO-CHEMICAL MIXING

(71) Applicant: Alcatel Lucent, Paris (FR)

(72) Inventors: Joanna Aizenberg, New Providence, NJ (US); Paul Robert Kolodner, Hoboken, NJ (US); Thomas Nikita Krupenkin, Warren, NJ (US)

(73) Assignee: Alcatel Lucent, Boulogne-Billancourt (FR)

( * ) Notice: Subject to any disclaimer, the term of this patent is extended or adjusted under 35 U.S.C. 154(b) by 327 days.

(21) Appl. No.: 14/247,791

(22) Filed: Apr. 8, 2014

(65) Prior Publication Data

US 2014/0216938 A1 Aug. 7, 2014

Related U.S. Application Data

(60) Division of application No. 11/319,865, filed on Dec. 27, 2005, now Pat. No. 8,734,003, which is a continuation-in-part of application No. 11/227,759, filed on Sep. 15, 2005, now Pat. No. 8,721,161.

(51) Int. Cl.

| | |
|---|---|
| ***B01L 3/02*** | (2006.01) |
| ***B01F 11/00*** | (2006.01) |
| ***B01F 13/00*** | (2006.01) |

(52) U.S. Cl.

CPC ..... *B01L 3/0241* (2013.01); *B01F 11/0071* (2013.01); *B01F 13/0071* (2013.01); *B01F 13/0076* (2013.01); *Y10T 436/25* (2015.01)

(58) Field of Classification Search

CPC ..... B01L 3/0255; B01L 3/0241; Y10T 436/2575; Y10T 436/25; B01F 11/0071; B01F 13/0071; B01F 13/0076

USPC ..... 366/127; 200/200, 201, 208, 233, 234, 200/235; 204/450, 547, 667

See application file for complete search history.

(56) References Cited

U.S. PATENT DOCUMENTS

| | | | |
|---|---|---|---|
| 3,268,320 | A | 8/1966 | Penberthy |
| 3,454,686 | A | 7/1969 | Jones |
| 3,670,130 | A | 6/1972 | Greenwood |
| 4,030,813 | A | 6/1977 | Kohashi et al. |
| 4,118,270 | A | 10/1978 | Pan et al. |
| 4,137,060 | A | 1/1979 | Timmermann |
| 4,338,352 | A | 7/1982 | Bear et al. |

(Continued)

FOREIGN PATENT DOCUMENTS

| | | | |
|---|---|---|---|
| DE | 19623270 | A | 1/1998 |
| DE | 19623270 | A | 1/1998 |

(Continued)

OTHER PUBLICATIONS

Welters, Wim JJ, and Lambertus GJ Fokkink. "Fast electrically switchable capillary effects." Langmuir 14.7 (1998): 1535-1538.

(Continued)

*Primary Examiner* — Tony G Soohoo
(74) *Attorney, Agent, or Firm* — Parker Justiss, PC

(57) ABSTRACT

A device comprising, a substrate having a droplet thereover, and an electrical source coupleable to the substrate. The electrical source is configured to apply a voltage between the substrate and the droplet using an electrode. The electrode has a first portion and a second portion non-symmetric to the first portion, the first and second portions defined by a plane located normal to a longitudinal axis and through a midpoint of a length of the electrode.

8 Claims, 8 Drawing Sheets

(56) References Cited

U.S. PATENT DOCUMENTS 4,341,310 A 7/1982 Sangiovanni et al.
4,390,403 A 6/1983 Batchelder
4,406,732 A 9/1983 Kayoun
4,569,575 A 2/1986 La Pesant et al.
4,583,824 A 4/1986 Lea
4,653,847 A 3/1987 Berg et al.
4,671,609 A 6/1987 Khoe et al.
4,708,426 A 11/1987 Khoe et al.
4,783,155 A 11/1988 Imataki et al.
4,784,479 A 11/1988 Ikemori
4,867,521 A 9/1989 Mallinson
4,948,214 A 8/1990 Hamblen
5,248,734 A 9/1993 Ober et al.
5,348,687 A 9/1994 Beck et al.
5,412,746 A 5/1995 Rossberg et al.
5,427,663 A 6/1995 Austin et al.
5,428,711 A 6/1995 Akiyama et al.
5,486,337 A 1/1996 Ohkawa
5,518,863 A 5/1996 Pawluczyk
5,659,330 A 8/1997 Sheridon
5,665,527 A 9/1997 Allen et al.
5,716,842 A 2/1998 Baier et al.
5,731,792 A 3/1998 Sheridon
5,922,299 A 7/1999 Bruinsma et al.
5,948,470 A 9/1999 Harrison et al.
6,014,259 A 1/2000 Wohlstadter
6,027,666 A 2/2000 Ozin et al.
6,185,961 B1 2/2001 Tonucci et al.
6,200,013 B1 3/2001 Takeuchi et al.
6,232,129 B1 5/2001 Wiktor
6,284,546 B1 9/2001 Bryning
6,294,137 B1 9/2001 McLaine
6,319,427 B1 11/2001 Ozin et al.
6,329,070 B1 12/2001 Sass et al.
6,369,954 B1 4/2002 Berge et al.
6,379,874 B1 4/2002 Ober et al.
6,387,453 B1 5/2002 Brinker et al.
6,409,907 B1 6/2002 Braun et al.
6,465,387 B1 10/2002 Pinnavaia et al.
6,471,761 B2 10/2002 Fan et al.
6,473,543 B2 10/2002 Bartels
6,538,823 B2 3/2003 Kroupenkine et al.
6,545,815 B2 4/2003 Kroupenkine et al.
6,545,816 B1 4/2003 Kroupenkine et al.
6,665,127 B2 12/2003 Bao et al.
6,686,207 B2 * 2/2004 Tupper ..... B01D 17/04 204/164
6,747,123 B2 6/2004 Chen et al.
6,778,328 B1 8/2004 Aizenberg et al.
6,790,330 B2 9/2004 Gascoyne et al.
6,829,415 B2 12/2004 Kroupenkine et al.
6,847,493 B1 1/2005 Davis et al.
6,891,682 B2 5/2005 Aizenberg et al.
6,936,196 B2 8/2005 Chandross et al.
6,965,480 B2 11/2005 Kroupenkine et al.
7,005,593 B2 2/2006 Gasparyan et al.
7,008,757 B2 3/2006 Reichmanis et al.
7,037,812 B2 * 5/2006 Kawahara ..... H05K 3/125 438/478
7,048,889 B2 5/2006 Arney et al.
7,106,519 B2 9/2006 Aizenberg et al.
7,110,646 B2 9/2006 Eggleton et al.
7,156,032 B2 1/2007 Kornblit et al.
7,168,266 B2 1/2007 Chen et al.
7,172,736 B2 2/2007 Kawamura et al.
7,204,298 B2 4/2007 Hodes et al.
7,211,223 B2 5/2007 Fouillet et al.
7,227,235 B2 6/2007 Kroupenkine et al.
7,255,780 B2 8/2007 Shenderov
7,507,433 B2 3/2009 Weber
7,611,614 B2 11/2009 Reel et al.
7,618,746 B2 11/2009 Kroupenkine et al.
7,749,646 B2 7/2010 Hodes et al.
7,767,069 B2 8/2010 Lee et al.
7,780,830 B2 * 8/2010 Haluzak ..... B01L 3/0255 204/450
7,785,733 B2 8/2010 Hodes et al.
7,875,160 B2 * 1/2011 Jary ..... F15C 5/00 204/450
8,124,423 B2 2/2012 Hodes et al.
8,529,774 B2 9/2013 Krupenkin et al.
8,721,161 B2 5/2014 Aizenberg et al.
8,734,003 B2 5/2014 Aizenberg et al.
2001/0036669 A1 11/2001 Jedrzejewski et al.
2002/0125192 A1 9/2002 Lopez et al.
2002/0196558 A1 12/2002 Kroupenkine et al.
2003/0020915 A1 1/2003 Schueller et al.
2003/0038032 A1 * 2/2003 Reel ..... B01L 3/502 204/643
2003/0129501 A1 7/2003 Megens et al.
2003/0148401 A1 8/2003 Agrawal et al.
2003/0183525 A1 10/2003 Elrod et al.
2003/0227100 A1 * 12/2003 Chandross ..... B29D 11/00365 264/1.36
2004/0018129 A1 1/2004 Kawamura et al.
2004/0031688 A1 2/2004 Shenderov
2004/0055891 A1 3/2004 Pamula et al.
2004/0058450 A1 3/2004 Pamula et al.
2004/0136876 A1 * 7/2004 Fouillet ..... B01F 13/0071 422/514
2004/0191127 A1 * 9/2004 Kornblit ..... B01F 13/0076 422/400
2004/0210213 A1 10/2004 Fuimaono et al.
2004/0211659 A1 10/2004 Velev
2005/0039661 A1 2/2005 Kornblit et al.
2005/0069458 A1 3/2005 Hodes et al.
2005/0115836 A1 6/2005 Reihs
2005/0203613 A1 9/2005 Arney et al.
2005/0211505 A1 9/2005 Kroupenkine et al.
2006/0108224 A1 5/2006 King et al.
2006/0172189 A1 8/2006 Kolodner et al.
2007/0048858 A1 3/2007 Aizenberg et al.
2007/0056853 A1 * 3/2007 Aizenberg ..... B01F 11/0071 1/71
2007/0058483 A1 3/2007 Aizenberg et al.
2007/0059213 A1 3/2007 Aizenberg et al.
2007/0059489 A1 3/2007 Hodes et al.
2007/0178463 A1 * 8/2007 Tanaami ..... G01N 27/447 435/6.11
2007/0207064 A1 * 9/2007 Kohara ..... B01F 13/0071 422/400
2007/0237025 A1 10/2007 Krupenkin et al.
2007/0272528 A1 11/2007 Gasparyan et al.
2008/0137213 A1 6/2008 Kuiper et al.
2008/0142376 A1 * 6/2008 Fouillet ..... B01L 3/502792 205/775
2009/0260988 A1 10/2009 Pamula et al.
2010/0110532 A1 5/2010 Takemoto et al.
2010/0116656 A1 5/2010 Garcia Tello et al.
2010/0320088 A1 * 12/2010 Fouillet ..... B01F 13/0071 204/454
2011/0114490 A1 * 5/2011 Pamula ..... B01F 11/0071 1/71
2012/0248229 A1 * 10/2012 Yang ..... B01F 13/0076 239/690
2013/0105318 A1 * 5/2013 Bhattacharya ..... B01F 13/0071 204/451
2013/0105319 A1 * 5/2013 Bhattacharya ..... B01F 13/0071 204/451

FOREIGN PATENT DOCUMENTS

DE 197 05 910 6/1998
DE 197 04 207 A1 8/1998
EP 0 290 125 11/1988
EP 1120164 8/2001
FR 2769375 4/1999
FR WO 99/18456 4/1999
WO WO 99/18456 4/1999
WO 99/54730 10/1999
WO WO 99/54730 10/1999

(56) References Cited

FOREIGN PATENT DOCUMENTS

| | | |
|---|---|---|
| WO | 01/31404 A1 | 5/2001 |
| WO | WO 01/31404 A1 | 5/2001 |
| WO | WO 01/42540 | 6/2001 |
| WO | 01/51990 | 7/2001 |
| WO | WO 01/51990 | 7/2001 |
| WO | 03/056330 | 7/2003 |
| WO | WO 03/056330 | 7/2003 |
| WO | 03/071335 | 8/2003 |
| WO | WO 03/071335 | 8/2003 |
| WO | 03/083447 | 10/2003 |
| WO | WO 03/083447 | 10/2003 |
| WO | 03/103835 | 12/2003 |
| WO | WO 03/103835 | 12/2003 |

OTHER PUBLICATIONS

Verheijen, H. J. J., and M. W. J. Prins. "Contact angles and wetting velocity measured electrically." Review of scientific instruments 70.9 (1999): 3668-3673.
Mach, P., et al. "Dynamic tuning of optical waveguides with electrowetting pumps and recirculating fluid channels." Applied physics letters 81.2 (2002): 202-204.
Krupenkin, T., et al., "From Rolling Ball to Complete Wetting on Dynamically Tunable Nanostructured Surfaces," Bell Labs Technical Journal, 2005 Lucent Technologies, Inc., vol. 10, No. 3, pp. 161-170.
Krupenkin, T., et al., "From Rolling Ball to Complete Wetting: The Dynamic Tuning of Liquids on Nanostructured Surfaces," 2004 American Chemical Society, vol. 20, 2004, pp. 3824-3827.
Chang, K., et al., "Nanograss Turns Sticky to Slippery in an Instant," The New York Times, nytime.com, Mar. 16, 2004, 2 pages.
Krupenkin, T., et al., "From Rolling Ball to Complete Wetting on Dynamically Tunable Nanostructured Surfaces," Abstracts [Y22. 006], Meeting of the American Physical Society in Montreal, Canada, Mar. 22-26, 2004, 1 page.
Weiss, P., et al., "Super-Repellent Surface Switches On and Off," Science News, Washington, Apr. 24, 2004, vol. 165, No. 17, p. 270.
Krupenkin, T., et al., " Eletrically Tunable Superhydrophobic Nanostructured Surfaces," Bell Labs Technical Journal, 2005 Lucent Technologies, Inc., vol. 10, No. 3, pp. 161-170.
Oprins, H., et al., "On-Chip Liquid Cooling with Integrated Pump Technology," 21st IEEE Semiconductor Thermal Measurement & Management Symposium, Mar. 15-17, 2005, 7 pages.
Pamula, V., et al., "Cooling of Integrated Circuits Using Droplet-Based Microfluidics," proceedings of the 13th ACM Great Lakes Symposium on VLSI, Washington DC, Apr. 28-29, 2003, pp. 84-87.
Krupenkin, T., et al., "Tunable Liquid Microlens," Applied Physics Letters, vol. 82, No. 3, Jan. 20, 2003, pp. 316-318.
Gonsalves, A., "Bell Labs Invention Could Mean Cooler Chips," http://www.techweb.com/wire/26804263, Mar. 12, 2004, 2 pages.
Weiss, P., et al., "Super-Repellent Surface Switches On and Off," Science News, Washington, vol. 165, Iss. 17, Apr. 24, 2004, pp. 270.
Schewe, P., et al., "Physics News 678, Tunable Surfaces" The American Institute of Physics Bulletin of Physics News No. 678, Mar. 26, 2004, 2 pages.
"Nanotech Makes Liquids Manageable," Energy Optimization News, May 1, 2004, 1 page.
"Bell Labs Scientists Discover Techniques to Control Fluids Using Specially Fabricated Silicon Nanograss," Lucent Technologies, Mar. 12, 2004, 3 pages.
Welters, W., et al., "Fast Electrically Switchable Capillary Effects," 1998 American Chemical Society, Langmuir, vol. 14, No. 7, Mar. 10, 1998, pp. 1535-1538.
Verheijen, H.J.J., et al., "Contact Angles and Wetting Velocity Measured Electrically," Review of Scientific Instruments, vol. 70, No. 9, Sep. 1999, pp. 3668-3673.
Mach, P., et al., "Dynamic Tuning of Optical Waveguides with Electrowetting Pumps and Recirculating Fluid Channels," Applied Physics Letters, vol. 81, No. 2, Jul. 8, 2002, pp. 202-204.
Cawse, P.A., et al., "The Determination of Nitrate in Soil Solutions by Ultraviolet Spectrophotomertry," Analyst, vol. 92, May 1967, pp. 311-315.
Cho, S. et al., "Creating Transporting, Cutting, and Merging Liquid Droplets by Electrowetting-Based Actuation for Digital Microfluidic Circuits," Journal of Microelectromechanical Systems, vol. 12, No. 1, Feb. 2003, pp. 70-80.
Brenn, G., et al., "Concentration Fields in Drying Droplets," CE&T Communications, Chemical Engineering Technology, 2004, vol. 27, No. 12, pp. 1252-1258.
Four (4) European Search Reports each dated Sep. 15, 2004.
Nanotech makes liquids manageable. Energy Optimization News, May 1, 2004.
Tunable surfaces. Physics News 678 (American Institute of Physics), Mar. 26, 2004.
Super-repellent surface switches on and off. P Weiss, Science News, Apr. 24, 2004.
Bell Labs invention could mean cooler chips. A Gonsalves, Techweb Network, Mar. 12, 2004.
'Nanograss' turns sticky to slippery in an instant. K Chang, New York Times, Mar. 16, 2004.
Krupenkin et al. Tunable liquid microlens. Applied Physics Letters 82 (2003) 316-318.
Pamula et al. Cooling of integrated circuits using droplet-based microfluidics. Proceedings of the 13th ACM Great Lakes symposium on VLSI, Washington DC, Apr. 28-29, 2003. Proceedings pp. 84-87.
Oprins et al. On-chip liquid cooling with integrated pump technology. Proceedings of the 21st IEEE Semi-Therm Symposium, San Jose, CA, Mar. 15-16, 2005.
Krupenkin et al. 2005. Electrically tunable superhydrophobic nanostructured surfaces. Bell Labs Technical Journal 10(3) (2005) 161-170.
Feng,Chuan Liang et. al., Reversible Wettability of Photoresponsive Flourine-Containing Azobenzene Polymer in Langmuir-Blodgett Films,• Lengmuir vol. 17,No. 15, 2001, pp. 4593-4597, American Chemical Society published on Wah. Jun. 22, 2001.
Aizenberg, J., et al., "Calcitic microlenses as part of the photoreceptor system in brittlestars." Nature. vol. 412. pp. 819-822. Aug. 23. 2001.
Ozbay, E., et al., "Measurement of a Three-Dimensional PhotonIc Band Gap in a Crystsl Structure Made of Dielectric Rods," PhysicalReview B, vol. 50, No. 3, Jul. 15, 1994, pp. 1945-1948.
Shoji, S., et al., "Photofabrication of Three-Dimensional Photonic Crystals by Multibeam Laser Interference Into a Photopolymarizable Resin," Applied Physics Letters, vol. 76, No. 19, May 8, 2000, pp. 2668-2670.
Taney, Peter T., et al: "A Neutral Templating Route to Mesaporous Molecular Sieves," Science, vol. 267, Feb. 1995, pp. 855-867.
Huo, Q. et al: "Generalized synthesis of periodic surfactant/inorganic composite materials," Nature, vol. 368, Mar. 1994, pp. 317-321.
Sanchez, C., et al: "Design and Properties of Hybrid Organic-Inorganic Nanocomposites for Photonics," MRS Bulletin, May 2001, pp. 377-387.
Yang, P., et al: "Hierarchically Ordered Oxides," Science, vol. 282, Dec. 1998, pp. 2244-2246. Templin, M. et al: "Organically Modified Aluminosilicate Mesostructures from Block Copolymer Phases," Science, vol. 278, Dec. 1997, pp. 1795-1798.
Brinker, C.J., et al., "Evaporation-Induced Self-Assembly: Nanostructures Made Easy" Advanced Materials, vol. 11, 1999, pp. 579-585.
Lee, Y-J., Braun, P.V., "Tunable Inverse Opal Hydrogel pH Sensors," Adv. Mater. 2003, 15, No. 7-8, Apr. 17, 2003, pp. 563-566.
Arsenault, A.C., et al., "A Polychromic, Fast Response Metallopolymer Gel Photonic Crystal with Solvent and Redox Tunability: A Step Towards Photonic Ink (P-Ink)," Adv. Mater. 2003, 15, No. 6, Mar. 17, 2003, pp. 503-507.
Leister Microsystems, leaflet by Leister Microsystems entitled, "Micro-optics—Imagine the Future of Light," Sep. 2000, 4 pages.
Jahns, J., et al., "Microoptics for biomedical applications," American Biotechnology Laboratory, No. 18, Oct. 2000, pp. 52 and 54.

(56) References Cited

OTHER PUBLICATIONS

Campbell, D.J., et al., "Replication and Compression of Bulk and Surface Structures with Pholydimethylsiloxane Elastomer," Journal of Chemical Education, vol. 75, No. 4, Apr. 1999, pp. 537-541.
Thrush, E., et al., "Integrated semiconductor fluorescent detection system for biochip and biomedical applications," IEEE-EMBS Special Topic Conference on Microtechnologies in Medicine & Biology, May 2002, pp. 374-379.
Shishido, A., et al., "Direct fabrication of two-dimensional titania arrays using interference photolithography," Applied Phyiscal Letters, vol. 79, No. 20, Nov. 12, 2001, pp. 3332-3334.
Young, "Organic-Inorganic Monomers," accessed at http://www.psrc.usm.edu/mauritz/nano2.html, Jul. 8, 2002.
Yang, et al., "Creating Periodic Three-Dimensional Structures by Multibeam Interference of Visible Laser," Chemistry of Materials, vol. 14, No. 7, Jul. 2002, pp. 2831-2833.
Vlasov et al., "On-Chip Netural Assembly of Silicon Photonic Bandgap Crystals," Nature, vol. 414, Nov. 15, 2001, pp. 289-293.
"Sol-Gel Chemistry," published online at http://www.sol-gel.com/chemi.htm, Dec. 9, 2002, 2 pages.
Abbot, N.L., et al. "Potential-Dependent Wetting of Aqubous Solutions on Self-Assembled Monolayers Formed from 15-(Ferrocenylcarbonyl) Pentadecaneithiol on Gold," Langmuir 1994, American Chemical Society, vol. 10, pp. 1493-1497.
Kim, et al, "Nanostructured Surfaces for Dramatic Reduction of Flow Resistance in Drop[let-Based Microfluidics," IEEE, pp. 479-482 (2002).
E.W. Becker, et al., "Fabrication of microstructures with high aspect ratios and great structural heights by synchrotron radiation lithography, galvanoforming, and plastic moulding (LIGA process)", Microelectronic Engineering, Elsevier Publishers BV., Amsterdam, NL, vol. 4, No. 1 (May 1, 1986), pp. 35-56.
Surface Energy Material (dynes/cm), ACCUDYNETE, "Solid Surface Energies," accessed at http://www.accudynetest.com/surface_energy_materials.html, Jul. 27, 2005 (3 pages).
Bhardwaj, et al., "Advances in High Rate Silicon and Oxide Etching using ICP", STS Ltd., Imperial Park, Newport, UK NP10 89UJ (6 pages).
Cawse, P.A., "The Determination of Nitrate in Soil Solutions by Ultraviolet Spectrophotometry", Analysit, May 1967, vol. 92, pp. 311-315.
Chang, K., "Nanograss Turns Sticky to Slippery in an Instant", New York Times, Mar. 16, 2004.
Brenn, Gunter, "Concentration Fields in Drying Droplets," Chemical Engineering & Technology 27.12 (2004); pp. 1252-1258.
Cho, S.K., et al., "Creating, Transporting, Cutting and Merging Liquid Droplets by Electrowetting-Based Actuation for Digital Microfluidic Circuits", Journal of Microelectromechanical Systems, vol. 12, No. 1, Feb. 2003, pp. 70-80.
U.S. Appl. No. 10/040,017, filed Jan. 4, 2002, Megens et al.
U.S. Appl. No. 10/094,093, filed Mar. 8, 2002, Eggleton et al.
U.S. Appl. No. 10/096,199, filed Mar. 12, 2002, Chandross et al.
U.S. Appl. No. 10/098,286, filed Mar. 15, 2002, Chen et al.
U.S. Appl. No. 10/135,973, filed Apr. 30, 2002, Z Bao et al.
U.S. Appl. No. 10/139,124, filed May 3, 2002, Kroupenkine et al.
U.S. Appl. No. 10/231,614, filed Aug. 30, 2002, Kroupenkine et al.
U.S. Appl. No. 10/321,027, filed Dec. 17, 2002, Reichmanis et al.
U.S. Appl. No. 10/383,150, filed Mar. 6, 2003, Chen et al.
U.S. Appl. No. 10/402,046, filed Mar. 28, 2003, Aizenberg et al.
U.S. Appl. No. 10/403,159, filed Mar. 31, 2003, Kornblit et al.
U.S. Appl. No. 10/631,996, filed Jul. 31, 2003, Aizenberg et al.
U.S. Appl. No. 10/637,837, filed Aug. 8, 2003, Davis et al.
U.S. Appl. No. 10/649,285, filed Aug. 27, 2003, Kornblit et al.
U.S. Appl. No. 10/674,448, filed Sep. 30, 2003, Hodes et al.
U.S. Appl. No. 10/716,084, filed Nov. 18, 2003, Kroupenkine et al.
U.S. Appl. No. 10/798,064, filed Mar. 11, 2004, Amey et al.
U.S. Appl. No. 10/803,565, filed Mar. 18, 2004, Hodes et al.
U.S. Appl. No. 10/803,576, filed Mar. 18, 2004, Kroupenkine et al.
U.S. Appl. No. 10/803,641, filed Mar. 18, 2004, Hodes et al.
U.S. Appl. No. 10/806,543, filed Mar. 23, 2004, Amey et al.
U.S. Appl. No. 10/810,774, filed Mar. 26, 2004, Krouopenkine et al.
U.S. Appl. No. 10/816,569, filed Apr. 1, 2004, Gasparyan et al.
Washizu, Masao, "Electrostatic Actuation of Liquid Droplets for Microreactor Applications," IEEE Transactions on Industry Applications, vol. 34, No. 4, Jul./Aug. 1998, pp. 732-737.
Schilling, Andreas et al., Surface Profiles of Reflow Microlenses Under the Influence of Surface Tension and Gravity, Opt. Eng. (39(8) pp. 2171-2176, Society of Photo-Optical Instrumentation Engineers, Aug. 2000.
Danzerbrink, R. et al., "Deposition of Micropatterned Coating Using an Ink-Jet Technique," Thin Solid Films 351, pp. 115-118, Elsevier Science S.A. (1999).
Feng, Chuan Llang et al "Reversible Wettability of Photoresponsive Flourine-Containing Azobenzene Polymer in Langmuir-Blodgett Films," Lengmulr vol. 17, No. 15, 2001, pp. 4593-4597, American Chemical Society, published on Web Jun. 22, 2001.
Ichimura, Kunihiro et al., "Light-Driven Motion of Liquids on a Photoresponsive Surface." Science. vol. 288. Jun. 2. 2000. pp. 1624-1626.
Commander, L.G. et al., "Variable Focal Length Microlenses," Optics Communications 177. Apr. 15, 2000. pp. 157-170.
Aizenberg, J., et al., "Calcitic microlenses as part of the photoreceptor system in brittlestars." Nature, vol. 412. pp. 819-822. Aug. 23. 2001.
English language translation of abstract for German Patent Document: DE 19623270 from European Patent Office database, esp@cenet.com, (1998), 1 page.
Tuberfield, A.J., "Photonic Crystals Made by Holographic Lithography," MRS. Bulletin. Aug. 2001. pp. 632-636.
Campbell, M., et al., "Fabrication of Photonic Crystals for the Visible Spectrum by Holographic Lithography," Nature, vol. 404, Mar. 2, 2000, pp. 53-56.
Ho, K.M., et al., "Existence of a Photonic Gap in Periodic Dielectric Structures," Physical Review Letters, vol. 65, No. 25, Dec. 17, 1990, pp. 3152-3155.
Ozbay, E., et al., "Measurement of a Three-Dimensional Photonic Band Gap in a Crystal Structure Made of Dielectric Rods," Physical Review B, vol. 50, No. 3, Jul. 15, 1994, pp. 1945-1948.
Tuberfield, A., "Photonic Crystals Made by Holographic Lithography," Abstract from Symposium K, Microphotonics—Materials, Phyisics, and Applications, Nov. 26-29, 2001, 1 page.
Shoji, S., et al., "Photofabrication of Three-Dimensional Photonic Crystals by Multibeam Laser Interference Into a Pholopolymarizable Resin," Applied Physics Letters, vol. 76, No. 19, May 8, 2000, pp. 2668-2670.
Sundararajan, N., et al., "Supercritical CO2 Processing for Submicron Imaging of Fluoropolymers," Chemistry of Materials, vol. 12, No. 1, Jan. 2000, pp. 41-48.
Kresge, C.T., et al: "Ordered mesoporous molecular sievas synthesized by a liquid-crystal template mechanism" Nature, vol. 359, Oct. 1992, pp. 710-712.
Taney, Peter T., et al: "A Neutral Templating Route to Mesaporous Molecular Sieves." Science. vol. 267. Feb. 1995. pp. 855-867.
Huo, Q. et al: "Generalized synthesis of periodic surfactant/inorganic composite materials." Nature. vol. 368. Mar. 1994. pp. 317-121.
Sanchez, C., et al: "Design and Properties of Hybrid Organic-Inorganic Nanocomposites for Photonics." MRS Bulletin. May 2001. pp. 377-387.
Yang, P., et al: "Hierarchically Ordered Oxides," Science, vol. 282, Dec. 1998, pp. 2244-2246. Templin, M. et al: "Organically Modified Aluminosilicate Mesostructures from Block Copolymer Phases," Science vol. 278 Dec. 1987 pp. 1795-1798.
Raman, N.K., et al: "Template-Based Approaches to the Preparation of Amorphous, Nanoporous Silicas," Chemical Matter, vol. 8, Feb. 1996, pp. 1682-1701.
Yang, P., et al: "Block Copolymer Templating Synthesis of Mesoporous Metal Oxides with Large Ordering Lengths and Semicrystalline Framework," Chemical Matter, vol. 11, 1999, pp. 2813-2826.
Brinker, C.J., et al., "Evaporation-Induced Self-Assembly: Nanostructures Made Easy" Advanced Materials. vol. 11. 1999. pp. 579-585.

(56) References Cited

OTHER PUBLICATIONS

Lee, Y-J., Braun, P.V., "Tunable Inverse Opal Hydrogel pH Sensors," Adv. Mater. 2003. 15. No. 7-8. Apr. 17, 2003. pp. 563-566.
Arsenault, A.C., et al., "A Polychromic, Fast Response Metallopolymer Gel Photonic Crystal with Solvent and Redox Tunablilty: A Step Towards Photonic Ink (P-Ink)," Adv. Mater. 2003, 15, No. 6, Mar. 17, 2003, pp. 503-507.
Zhang, S., et al., "Materials and techniques for electrochemical biosensor design and construction," Biosensors & Bioelectronics 15, (2000), pp. 273-282.
Wu, H., et al., "Reduction Photolithography Using Microlens Arrays: Applications in Gray Scale Photolithography," Analytical Chemistry, vol. 74, No. 14, Jul. 15, 2002, pp. 3267-3273.
Leister Microsystems, leaflet by Leister Microsystems entitled, "Micro-optics—Imagine the Future of Light." Sep. 2000. 4 pages.
Stokes, D.L., et al., "Detection of *E. coli* using a microfluidics-based Antibody Biochip detection systems," Fresenius, J. Anal Chem (2001) 369, pp. 295-301.
Jahns, J., et al., "Microoptics for biomedical applications," American Biotechnology Laboratory, No. 18. Oct. 2000. pp. 52 and 54.
Campbell, D.J., et al., "Replication and Compression of Bulk and Surface Structures with Pholydlmethylsiloxane Elastomer," Journal of Chemical Education, vol. 75, No. 4, Apr. 1999, pp. 537-541.
Kruk, M., et al., "Mesoporous Silicate-Surfactant Composites with Hydrophobic Surfaces and Tailored Pore Sizes"; Journal of Physical Chemistry 106 B (2002) pp. 10096-10101.
Thrush, E., et al., "Integrated semiconductor fluorescent detection system for biochip and biomedical applications," IEEE-EMBS Special Topic Conference on Microtechnologles in Medicine & Biology, May 2002, pp. 374-378.
Avgeropoulos, et al., "Synthesis and Morphological Behavior of Silicon-Containing Triblock Copolymers for Nanostructure Applications," Chem. Mater. 1998, 10, pp. 2109-2115.
Chan, Vanessa A-H., et al., "Ordered Bicontinuous Nanoporous and Nanorelief Ceramic Films from Self-Assembling Polymer Precursors," Science, Nov. 26, 1999, vol. 286, pp. 1716-1719.
Shishido, A., et al., "Direct fabrication of two-dimensional titania arrays using interference photolithography," Applied Phylscal Letters, vol. 79, No. 20, Nov. 12, 2001, pp. 3332-3334.
Young, "Organic-Inorganic Monomers," accessed at http://www.psrc.usm.edu/mauritz/nano2.html. Jul. 8, 2002.
Yang, et al., "Creating Periodic Three-Dimensional Structures by Muitibeam Interference of Visible Laser," Chemistry of Materials, vol. 14, No. 7, Jul. 2002, pp. 2831-2833.
Vlasov et al., "On-Chip Netural Assembly of Silicon Photonic Bandgap Crystals." Nature, vol. 414. Nov. 15, 2001. pp. 289-293.
Baney, et al., "Silsesquioxanes," American Chemical Society, 1995, pp. 1409-1430.
The Wittman Company, "Carbon Dioxide," published online at http://www.witteman.com/co2.htm, Dec. 4, 2002, 2 pages.
"Sol-Gel Chemistry," published online at http://www.sol-gel.com/chemi.htm, Dec. 9, 2002. 2 pages.
Abbot, N.L., et al., "Potential-Dependent Wetting of Aqueous Solutions on Self-Assembled Monolayers Formed from 15-(Ferrocenylcarbonyl) pentadecanethiol on Gold," Langmuir 1994, American Chemical Society, vol. 10, pp. 1493-1497.
Kim, et al, "Nanostructured Surfaces for Dramatic Reduction of Flow Resistance in Drop[let-Based Microfluidics." IEEE. pp. 479-482 (2002).
E.W. Becker, et al., "Fabrication of microstructures with high aspect ratios and great structural heights by synchrotron radiation lithography, galvanoforming, and plastic moulding (LIGA process)", Microelectronic Engineering Elsevier Publishers, Amsterdam NL, vol. 4 No. 1 (Jun. 1, 1986), pp. 35-56.
Surface Energy Material (dynes/cm), ACCUDYNETE, "Solid Surface Energies," accessed at http://www.accudynetest.com/surface_energy_materials.html, Jul, 27, 2005 (3 pages).
eFunda: General Information on Element Silicon, accessed at http://www.efunda.com/materials/elements/element_info.cfm?Element_ID=SI, Aug. 10, 2005 (8 pages).
Bhardwaj, et al., "Advances in High Rate Silicon and Oxide Etching using ICP", STS Ltd., Imperial Park, Newport, UK NP10 89UJ (6 pags).
Templin, et al., "Organically Modified Aluminosilicate Mesostructrures from block Copolymer Phases", www.sciencemag.org, Science, vol. 278, Dec. 5, 1997, pp. 1795-1798.
Glod, et al., "An Investigation of microscale explosive vaporization of water on an utrathin Pt wire", International Journal of Heat and Mass Transfer 45 (2002), pp. 367-379.
Aizenberg, et al., patent application for "A Low Adsorption Surface" filed Aug. 31, 2005.

* cited by examiner

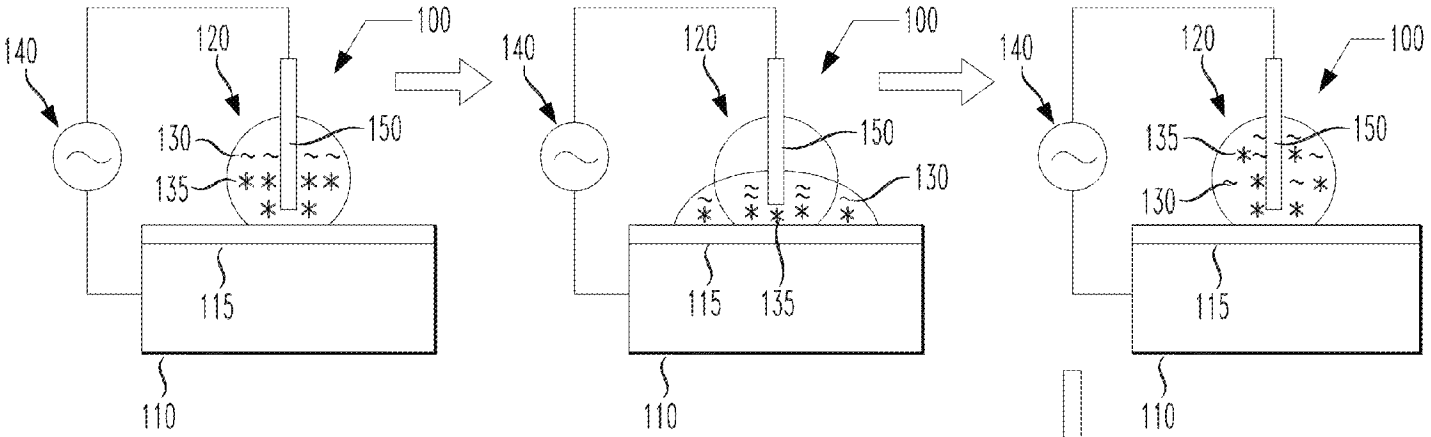
FIG. 1A
FIG. 1B
FIG. 1C
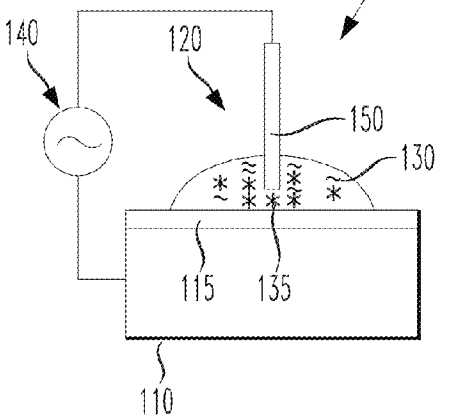
FIG. 1D
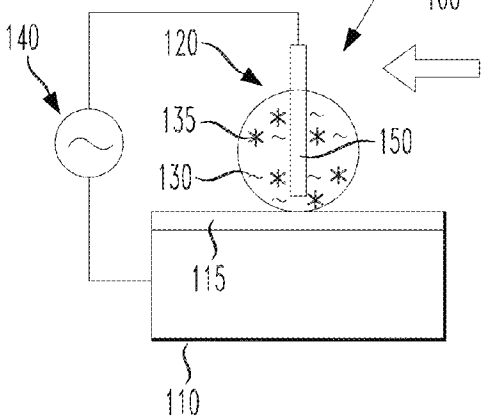
FIG. 1E

MICRO-CHEMICAL MIXING

CROSS-REFERENCE TO RELATED APPLICATIONS

This Application is a Divisional of U.S. application Ser. No. 11/319,865 which was filed on Dec. 27, 2005, to Aizenberg, et al, entitled "MICRO-CHEMICAL MIXING," now granted as U.S. Pat. No. 8,734,003, which in turn is a Continuation-in-Part of U.S. application Ser. No. 11/227,759 filed on Sep. 15, 2005, to Joanna Aizenberg, et al., entitled "FLUID OSCILLATIONS ON STRUCTURED SURFACES," now granted as U.S. Pat. No. 8,721,161, all of which are commonly assigned with the present invention, and fully incorporated herein by their entirety by reference.

TECHNICAL FIELD OF THE INVENTION

The present invention is directed, in general, to a device and a method for mixing two or more species within a droplet.

BACKGROUND OF THE INVENTION

One problem encountered when handling small fluid volumes is to effectively mix different fluids together. For instance, poor mixing can occur in droplet-based microfluidic devices, where the fluids are not confined in channels. In droplet based systems, small droplets of fluid (e.g., fluid volumes of about 100 microliters or less) are moved and mixed together on a surface. In some cases, it is desirable to add a small volume of a reactant to a sample droplet to facilitate the analysis of the sample, without substantially diluting it. In such cases, there is limited ability to mix the two fluids together because there is no movement of the fluids to facilitate mixing.

Embodiments of the present invention overcome these problems by providing a device and method that facilitates the movement and mixing of small volumes of fluids.

SUMMARY OF THE INVENTION

To address the above-discussed deficiencies of the prior art, the present invention provides a device. The device, without limitation, includes a substrate having a droplet thereover, and an electrical source coupleable to the substrate, the electrical source configured to apply a voltage between the substrate and the droplet using an electrode, wherein the electrode has a first portion and a second portion non-symmetric to the first portion, the first and second portions defined by a plane located normal to a longitudinal axis and through a midpoint of a length of the electrode.

BRIEF DESCRIPTION OF THE DRAWINGS

The invention is best understood from the following detailed description when read with the accompanying FIGUREs. It is emphasized that, in accordance with the standard practice in the semiconductor industry, various features are not drawn to scale. In fact, the dimensions of the various features may be arbitrarily increased or reduced for clarity of discussion. Reference is now made to the following descriptions taken in conjunction with the accompanying drawings, in which:

FIGS. 1A thru 1E illustrate cross-sectional views of a device while undergoing a process for mixing two or more species within a droplet in accordance with the principles of the present invention;

DETAILED DESCRIPTION

Figure 2B:
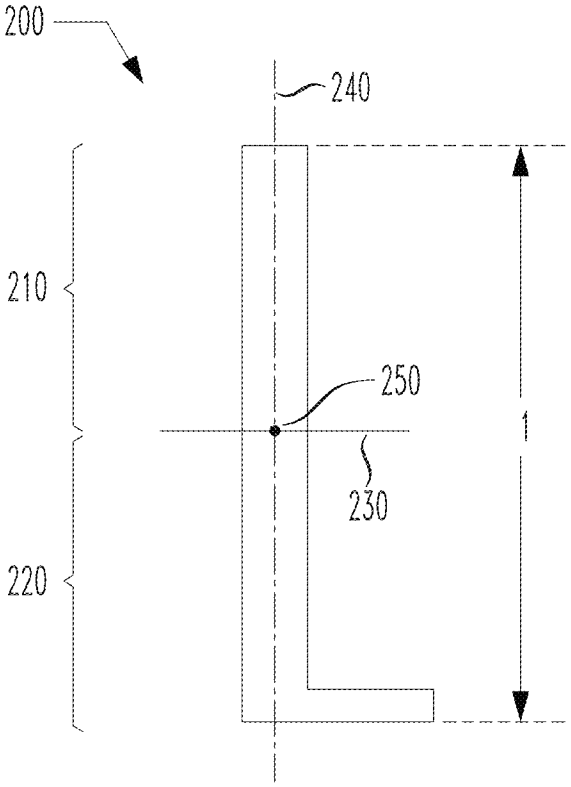
FIGS. 2A thru 2D illustrate different objects, in this embodiment electrodes, that might be used in place of the object illustrated in FIGS. 1A thru 1E.
Figure 2A:
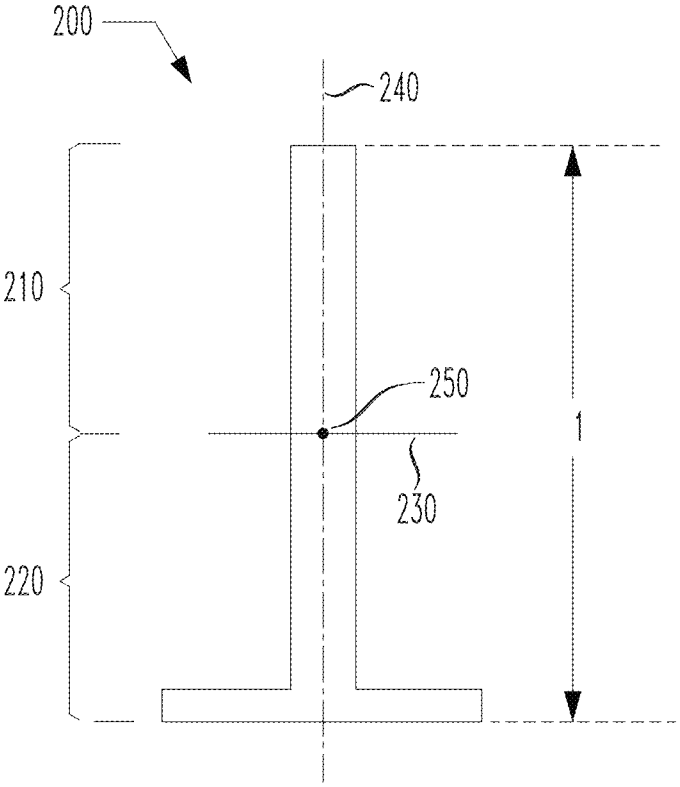
Figure 2D:
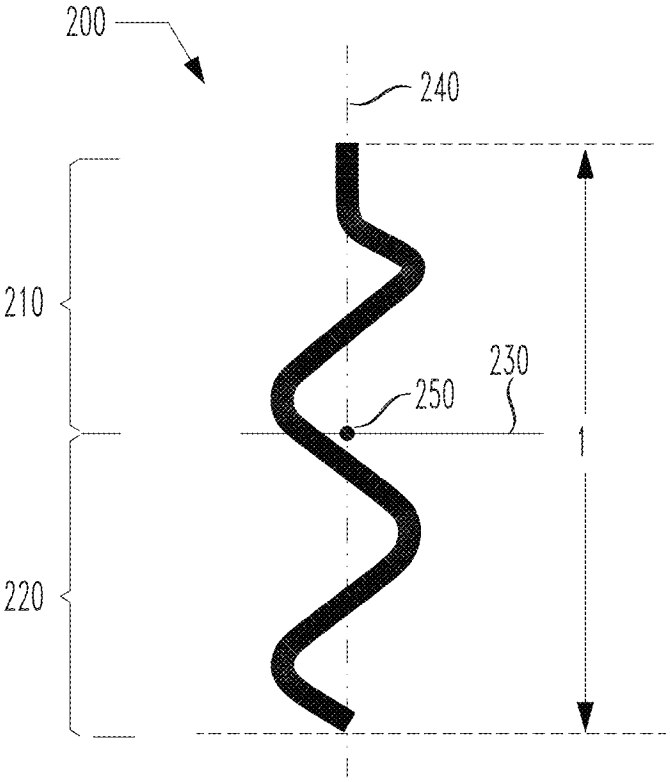
Figure 2C:
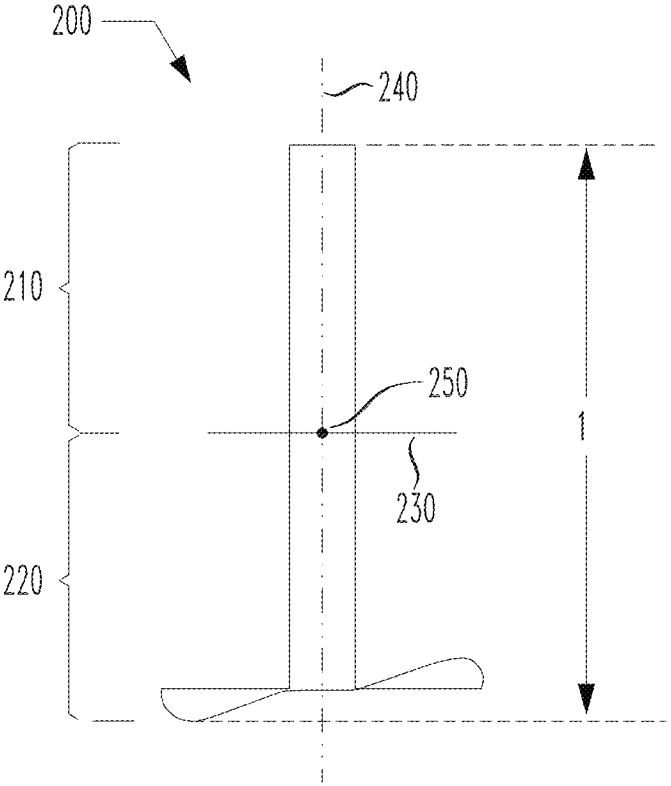

The present invention recognizes that the vertical position of a droplet (e.g., a droplet of fluid) can be made to oscillate on certain kinds of substrates. In certain embodiments, the vertical position of the droplet can be made to oscillate on a conductive substrate having fluid-support-structures thereon. The application of a voltage between the substrate and the droplet may cause the droplet to alternate between a state with a high contact angle (e.g., a less flattened configuration or a non-wetted state) and a state with a lower contact angle (e.g., a more flattened configuration or a wetted state). In such embodiments the substrate comprises a pattern of fluid-support-microstructures, the applied voltage causing a surface of the droplet to move between tops of the fluid-support-microstructures and the substrate on which the microstructures are located. Such movements cause the droplet to move between effective more flattened and less flattened states, respectively.

As part of the present invention, it was further discovered that repeatedly deforming (e.g., oscillating) the droplet in this manner promotes mixing of two or more species (e.g., chemical species) within the droplet. For instance, the repeated deformation of the droplet can induce motion within the droplet, thereby promoting mixing of the two or more species of fluids. Without being limited to such, it is believed that the movement of the droplet with respect to an object located therein promotes the mixing, the object may for example be an electrode used to provide the voltage.

Turning now to FIGS. 1A thru 1E illustrated are cross-sectional views of a device 100 while a droplet undergoes a process for mixing two or more species therein in accordance with the principles of the present invention. The device 100 of FIGS. 1A thru 1E initially includes a substrate 110. The substrate 110 may be any layer located within a device and having properties consistent with the principles of the present invention. For instance, in one exemplary embodiment of the present invention the substrate 110 is a conductive substrate.

Some preferred embodiments of the conductive substrate 110 comprise silicon, metal silicide, or both. In some preferred embodiments, for example, the conductive substrate 110 comprises a metal silicide such as cobalt silicide. However, other metal silicides, such as tungsten silicide or nickel silicide, or alloys thereof, or other electrically conductive materials, such as metal films, can be used.

In the embodiment wherein the substrate 110 is a conductive substrate, an insulator layer 115 may be disposed thereon. Those skilled in the art understand the materials that could comprise the insulator layer 115 while staying within the scope of the present invention. It should also be noted that in various embodiments of the present invention, one or both of the substrate 110 or insulator layer 115 has hydrophobic properties. For example, one or both of the substrate 110 or insulator layer 115 might at least partially comprise a low-surface-energy material. For the purposes of the present invention, a low-surface-energy material refers to a material having a surface energy of about 22 dyne/cm (about $22\times10^{-5}$ N/cm) or less. Those of ordinary skill in the art would be familiar with the methods to measure the surface energy of such a material. In some preferred embodiments, the low-surface-energy material comprises a fluorinated polymer, such as polytetrafluoroethylene, and has a surface energy ranging from about 18 to about 20 dyne/cm.

Located over the substrate 110 in the embodiment shown, and the insulator layer 115 if present, is a droplet 120. The droplet 120 may comprise a variety of different species and fluid volumes while staying within the scope of the present invention. In one exemplary embodiment of the present invention, however, the droplet 120 has a fluid volume of about 100 microliters or less. It has been observed that the methodology of the present invention is particularly useful for mixing different species located within droplets 120 having fluid volumes of about 100 microliters or less. Nevertheless, the present invention should not be limited to any specific fluid volume.

Located within the droplet 120 in the embodiments of FIGS. 1A thru 1E are a first species 130 and a second species 135. For the purpose of illustration, the first species 130 is denoted as (~) and the second species is denoted as (*). The first species 130 may be a diluent or a reactant. Similarly, the second species 135 may be a diluent or a reactant. In the exemplary embodiment shown, however, the first species 130 is a first reactant and the second species 135 is a second reactant, both of which are suspended within a third species, such as a diluent.

Some preferred embodiments of the device 100 also comprise an electrical source 140 (e.g., an AC or DC voltage source) coupled to the substrate 110 and configured to apply a voltage between the substrate 110 and the droplet 120 located thereover. In the illustrative embodiment of FIGS. 1A thru 1E, the electrical source 140 uses an object 150, such as an electrode, to apply the voltage. While the embodiment of FIGS. 1A thru 1E illustrates that the object 150 is located above the substrate 110, other embodiments exist wherein the object 150 contacts the droplet 120 from another location, such as from below the droplet 120. Those skilled in the art understand how to configure such an alternative embodiment. Moreover, as will be discussed more fully below, the object 150 may take on a number of different configurations and remain within the purview of the present invention.

Given the device 100 illustrated in FIGS. 1A thru 1E, the first species 130 and the second species 135 may be at least partially mixed within the droplet 120 using the inventive aspects of the present invention. Turning initially to FIG. 1A, the droplet is positioned in its less flattened state. For instance, because substantially no voltage is applied between the substrate 110 and the droplet 120, the droplet is in its natural configuration. It should be noted that the first species 130 and the second species 135 located within the droplet of FIG. 1A are substantially, if not completely, separated from one another.

Turning now to FIG. 1B, illustrated is the device 100 of FIG. 1A, after applying a non-zero voltage between the substrate 110 and the droplet 120 using the electrical source 140 and the object 150. As would be expected, the droplet 120 moves to a flattened state, and thus is in its deformed configuration. It is the movement of the object 150 within the droplet 120 that is believed to promote the mixing of the first species 130 and the second species 135. It should be noted, however, that other phenomena might be responsible for at least a portion of the mixing.

In some cases, the electrical source 140 is configured to apply a voltage ranging from about 1 to about 50 Volts. It is sometimes desirable for the voltage to be applied as a brief pulse so that the droplet 120 after becoming flattened can bounce back up to its less flattened state. In some cases, the applied voltage is a series of voltage pulses applied at a rate in the range from about 1 to 100 Hertz, and more preferably from about 10 to 30 Hertz. In other cases, the applied voltage is an AC voltage. In some preferred embodiments, the AC voltage has a frequency in the range from about 1 to about 100 Hertz. One cycle of droplet oscillation is defined to occur when the droplet 120 makes a round-trip change from the less flattened state to the more flattened state and back up to the less flattened state, or from the more flattened state to the less flattened state and back down to the more flattened state. Take notice how the first species 130 and the second species 135 in the embodiment of FIG. 1B are slightly more mixed within the droplet 120 than the first species 130 and second species 135 in the droplet 120 of FIG. 1A.

Turning now to FIG. 1C, illustrated is the device 100 of FIG. 1B after removing the voltage being applied via the electrical source 140 and object 150. Thus, the droplet 120 substantially returns to its less flattened state, and has therefore made one complete cycle of movement. As one would expect based upon the disclosures herein, the movement from the more flattened state of FIG. 1B to the less flattened state of FIG. 1C may promote additional mixing. Accordingly, the first species 130 and second species 135 may be more mixed in the droplet 120 of FIG. 1C than the droplet 120 of FIG. 1B.

Moving on to FIGS. 1D and 1E, the droplet 120 undergoes another cycle of movement, thus further promoting the mixing of the first species 130 and second species 135 therein. In accordance with the principles of the present invention, the droplet 120 may repeatedly be deformed, until a desired amount of mixing between the first species 130 and the second species 135 has occurred. The number of cycles, and thus the amount of mixing between the first species 130 and the second species 135, may be based upon one or both of a predetermined number of cycles or a predetermined amount of time. In any event, addition mixing typically occurs with each cycle, at least until the first species 130 and second species 135 are completely mixed.

Uniquely, the present invention uses the repeated deformation of the droplet 120 having the object 150 therein to accomplish mixing of the first species 130 and second species 135 within the droplet 120. Accordingly, wherein most methods for mixing the species within the droplet would be based upon the relative movement of the object 150 with respect to the droplet 120, the present invention is based upon the movement of the droplet 120 with respect to the object 150. For instance, in most preferred embodiments the object 150 is fixed, and thus stationary, and it is the movement of the droplet 120 using the electrical source 140 that promotes the movement.

This being said, the method disclosed herein provides what is believed to be unparalleled mixing for two or more species within a droplet. Namely, the method disclosed herein in capable of easily mixing two or more species that might be located within a droplet having a fluid volume of about 100 microliters or less. Prior to this method, easy mixing of such small volumes was difficult, at best.

In various embodiments, the object 150 is positioned asymmetric along the axis of motion of the droplet being physically distorted. For example, the object 150 may be positioned a non-zero angle away from the direction of movement of the droplet during mixing. This non-zero angle might be used to introduce increased mixing.

The embodiments of FIGS. 1A thru 1E are droplet based micro fluidic system. It should be noted, however, that other embodiments might consist of micro channel based micro fluidic systems, wherein the droplet might be located within a channel and the mixing occurring within one or more channels, as opposed to that shown in FIGS. 1A thru 1E. Those skilled in the art understand just how the inventive aspects of the present invention could be employed with such a micro channel based micro fluidic system.

Turning now to FIGS. 2A thru 2D, illustrated are different objects 200, in this embodiment electrodes, that might be used in place of the object 150 illustrated in FIGS. 1A thru 1E. Specifically, the objects 200 illustrated in FIGS. 2A thru 2D each have a first portion 210 and a second portion 220 non-symmetric to the first portion 210. In these embodiments, the first and second portions 210, 220, are defined by a plane 230 located normal to a longitudinal axis 240 and through a midpoint 250 of a length (l) of the object 200. As is illustrated in FIGS. 2A thru 2D, the first portion 210 located above the plane 230 is non-symmetric to the second portion 220 located below the plane 230.

To accomplish the aforementioned non-symmetric nature of the object 200, the object 200 may take on many different shapes. For example, the object 200 of FIG. 2A comprises an inverted T, or depending on the view, a disk disposed along a shaft. Alternatively, the object 200 of FIG. 2B comprises an L, the object 200 of FIG. 2C comprises a propeller and the object 200 of FIG. 2D comprises a helix. Each of the different shapes of FIGS. 2A thru 2D provide increased mixing when the droplet moves with respect to the object as discussed with respect to FIGS. 1A thru 1E above, at least as compared to the symmetric object 150 illustrated in FIGS. 1A thru 1E. For instance, what might take a first species about 10 minutes to mix with a second species using only simple diffusion, might only take about 1 minute using the object 150 illustrated in FIGS. 1A thru 1E, and further might only take about 15 seconds using an object similar to the object 200 illustrated in FIG. 2D. Thus, the object 150 of FIGS. 1A thru 1E might provide about 10 times the mixing as compared to passive diffusion, whereas the objects 200 of FIGS. 2A thru 2D might provide about 30 times the mixing as compared to passive diffusion. Obviously, the aforementioned improvements are representative only, and thus should not be used to limit the scope of the present invention.

Figure 3:
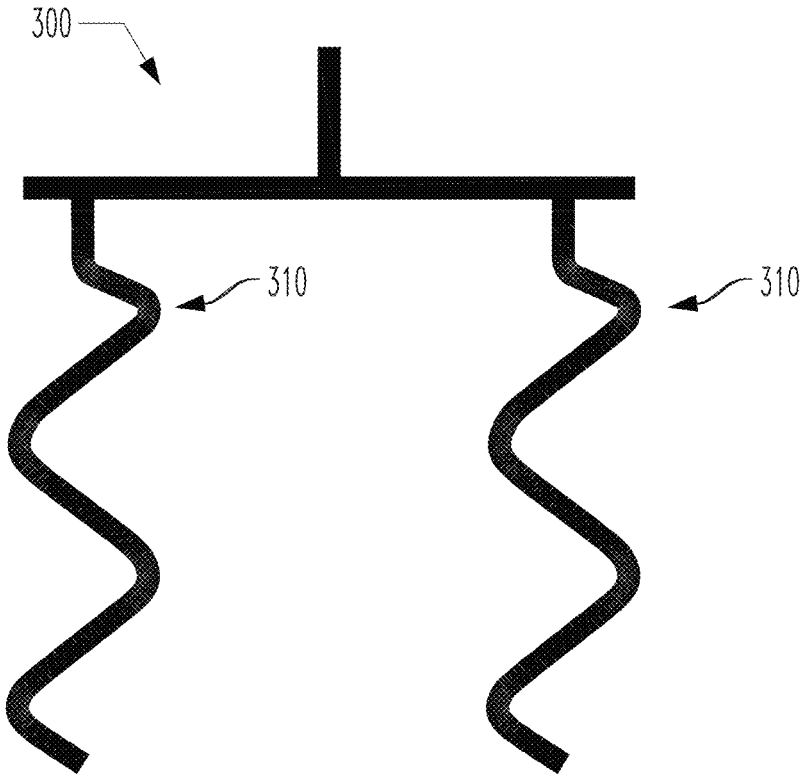
FIG. 3 illustrates an alternative embodiment of an object that might be used with the methodology discussed above with respect to FIGS. 1A thru 1E.

Turning briefly to FIG. 3, illustrated is an alternative embodiment of an object 300 that might be used with the methodology discussed above with respect to FIGS. 1A thru 1E. The object 300 of FIG. 3, as compared to the objects 150, 200 of FIGS. 1A thru 1E and 2A thru 2D, respectively, comprises multiple vertical sections 310. The vertical sections 310 attempt to create a swirling effect within the droplet, thereby providing superior mixing of the two or more species. While each of the vertical sections 310 illustrated in FIG. 3 are shown as helix structures, similar to the object 200 of FIG. 2D, other embodiments exist wherein each of the vertical sections 310 are similar to any one of the shapes illustrated in previous FIGUREs, as well as other shapes neither disclosed nor shown.

Figure 4:
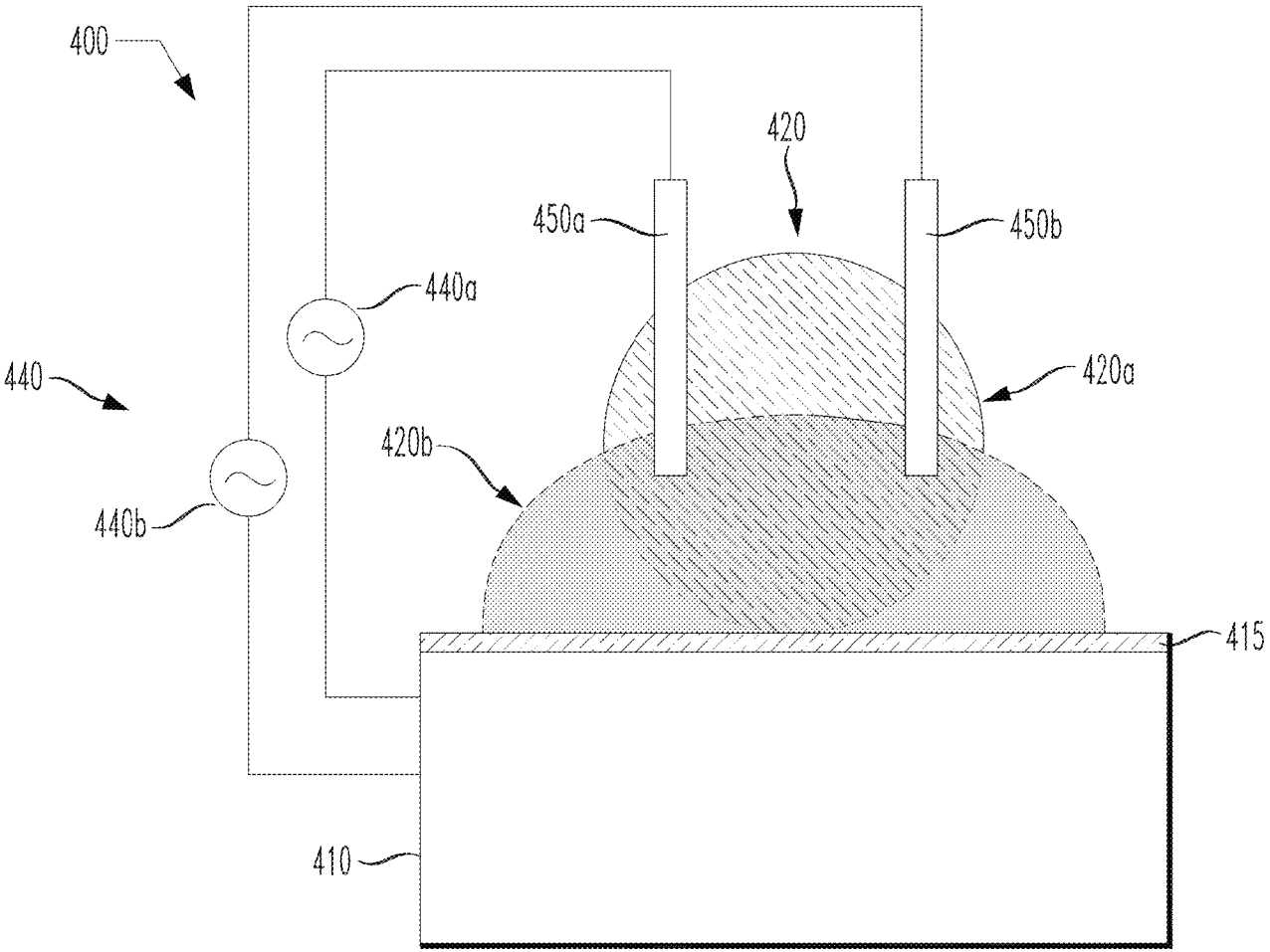
FIG. 4 illustrates a cross-sectional view of an alternative embodiment of a device while undergoing a process for mixing two or more species within a droplet in accordance with the principles of the present invention.

Turning now to FIG. 4, illustrated is a cross-sectional view of an alternative embodiment of a device 400 while undergoing a process for mixing two or more species within a droplet in accordance with the principles of the present invention. The device 400 of FIG. 4 is substantially similar to the device 100 illustrated in FIGS. 1A thru 1E, with the exception that multiple objects 450*a* and 450*b* are positioned at different locations within the droplet 420. In an exemplary embodiment, each one of the multiple objects 450*a* and 450*b* is an individually addressable electrode. For instance, each one of the multiple objects 450*a* and 450*b* may be connected to different electrical sources 440*a* and 440*b*, respectively, thereby providing the ability to address them individually. In an alternative embodiment, each one of the multiple objects 450*a* and 450*b* could be connected to the same electrical source 440, whether it be a fixed or variable electrical source, and switches could be placed between the electrical source 440 and each one of the multiple objects 450*a* and 450*b*. Thus, the switches would allow for the ability to address each one of the multiple objects 450*a* and 450*b* individually.

The device 400 of FIG. 4 might be operated by alternately applying a voltage between the multiple objects 450*a* and 450*b*. In such an operation, an additional in-plane oscillation of the droplet 420 between the multiple objects 450*a* and 450*b* might occur. Accordingly, wherein the device 100 of FIGS. 1A thru 1E might only cause the droplet 120 to move normal to the surface on which it rests, the device 400 of FIG. 4 might cause the droplet 420 to have this additional in-plane movement (e.g., along the surface on which it rests). As those skilled in the art appreciate, this additional in-plane movement may induce increased mixing, at least as compared to the movement created in the droplet 120 of FIGS. 1A thru 1E.

As an extension of this point, those skilled in the art could design certain more complex geometries, with numerous addressable objects, to ensure rigorous mixing due to the induced movement of the droplet in the different directions. For example, such rigorous mixing might be induced using a device having its objects positioned as follows:

A
B C D
E

By using the combination of these five independent objects (e.g., electrodes A, B, C, D and E) one can either induce normal up and down movement of the droplet by applying a voltage to object C (such as is illustrated with respect to FIGS. 1A thru 1E), induce an in-plane movement of the droplet by applying an alternating voltage between objects A and E or B and D (such as is illustrated with respect to FIG. 4 above), or induce a spinning movement of the droplet by sequentially applying a voltage to objects A, B, E and D. Obviously, other complex geometries might provide even more significant mixing.

Figure 5:
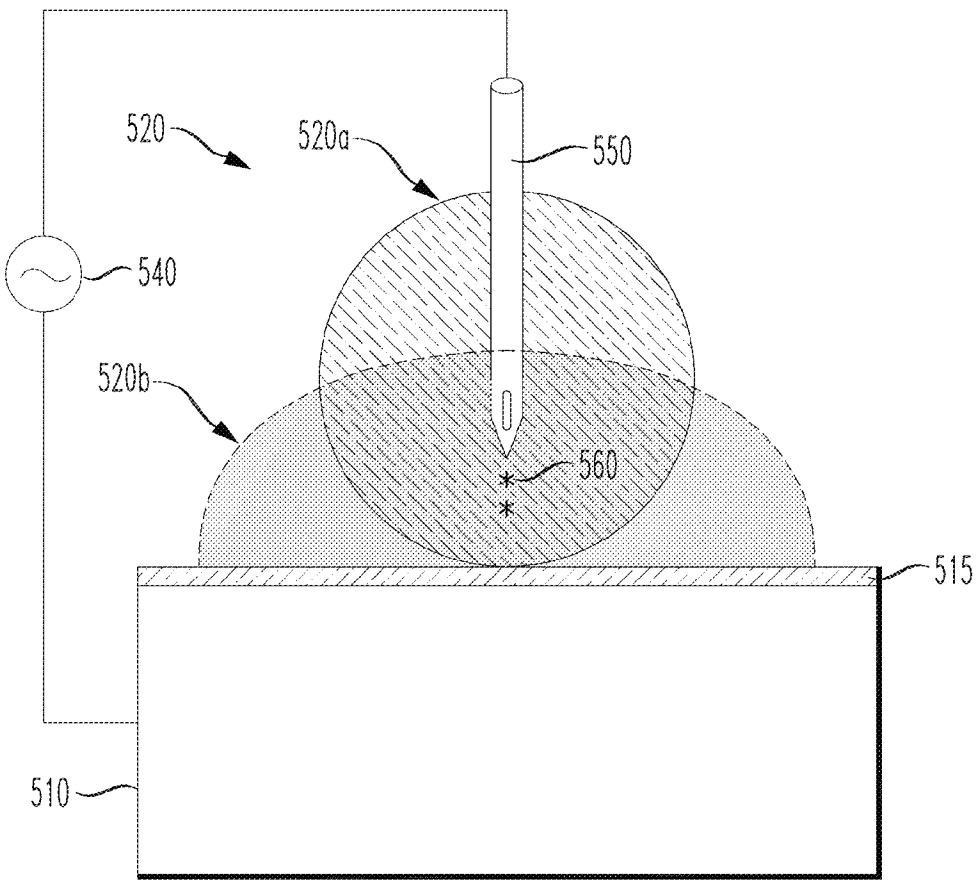
FIG. 5 illustrates an alternative embodiment of a device in accordance with the principles of the present invention.

Turning now to FIG. 5, illustrated is an alternative embodiment of a device 500 in accordance with the principles of the present invention. The embodiment of the device 500 includes a substrate 510, an insulator layer 515, a droplet 520 (in both a less flattened state 520*a* and a more flattened state 520*b*), an electrical source 540 and an object 550. In this embodiment, the object 550 is both configured to act as a hollow needle, and thus is configured to supply one or more species 560 to the droplet 520, and well as configured to apply a voltage across the droplet 520. Thus, in the embodiment shown, the object 550 is an electrode also configured as a hollow needle, or vice-versa.

Those skilled in the art understand the many different shapes for the object 550 that might allow the object 550 to function as both the electrode and the needle. For that matter, in addition to a standard needle shape, each of the shapes illustrated in FIGS. 2A thru 2D could be configured as a needle, thus providing both functions. Other shapes could also provide both functions and remain within the purview of the present invention.

It should also be noted that rather than the object 550 being configured as a single needle having a single fluid channel to provide a species 560, the object 550 could comprise a plurality of fluid channels to provide a plurality of different species 560 to the droplet 520. For example, in one embodiment, the object 550 comprises a cluster of different needles, each different needle having its own fluid channel configured to provide a different species 560. In another embodiment, however, the object 550 comprises a single needle, however the single needle has a plurality of different fluid channels for providing the different species 560. Other configurations, which are not disclosed herein for brevity, could nevertheless also be used to introduce different species 560 within the droplet 520. The above-discussed embodiments are particularly useful wherein there is a desire to keep the different species separate from one another, such as wherein the two species might undesirably react with one another.

The device 500 including the object 550 may, therefore, be used to include any one or a collection of species 560 within the droplet 520. The object 550 may, in addition to the ability to provide one or more species 560 within the droplet 520, also function as an electrode to move the droplet 520 using electrowetting, mix two or more species within the droplet 520 using the process discussed above with respect to FIGS. 1A thru 1E, or any other known or hereafter discovered process.

Figure 6:
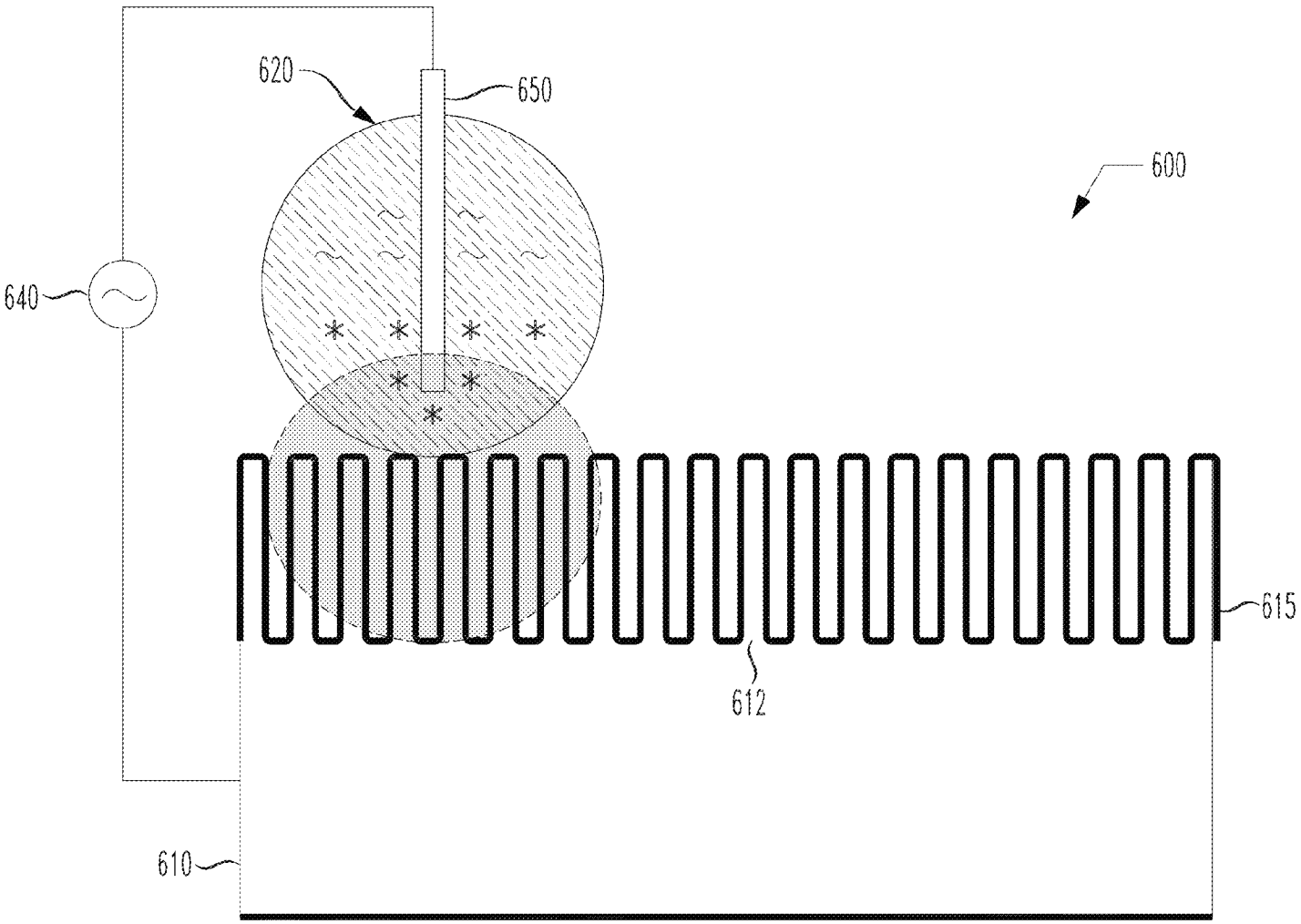
FIG. 6 illustrates a cross-sectional view of an alternative embodiment of a device while undergoing a process for mixing two or more species within a droplet in accordance with the principles of the present invention.

Turning now to FIG. 6, illustrated is a cross-sectional view of an alternative embodiment of a device 600 while undergoing a process for mixing two or more species within a droplet in accordance with the principles of the present invention. The device 600 of FIG. 6 initially includes a substrate 610. The device 600 also includes fluid-support-structures 612 that are located over the substrate 610. Each of the fluid-support-structures 612, at least in the embodiment shown, has at least one dimension of about 1 millimeter or less, and in some cases, about 1 micron or less. As those skilled in the art appreciate, the fluid-support-structures 612 may comprise microstructures, nanostructures, or both microstructure and nanostructures.

In some instances, the fluid-support-structures 612 are laterally separated from each other. For example, the fluid-support-structures 612 depicted in FIG. 6 are post-shaped, and more specifically, cylindrically shaped posts. The term post, as used herein, includes any structures having round, square, rectangular or other cross-sectional shapes. In some embodiments of the device 600, the fluid-support-structures 612 form a uniformly spaced array. However, in other cases, the spacing is non-uniform. For instance, in some cases, it is desirable to progressively decrease the spacing between fluid-support-structures 612. For example, the spacing can be progressively decreased from about 10 microns to about 1 micron in a dimension.

In the embodiment shown, the fluid-support-structures 612 are electrically coupled to the substrate 610. Moreover, each fluid-support-structure 612 is coated with an electrical insulator 615. One suitable insulator material for the electrical insulator 615 is silicon dioxide.

Exemplary fluid-support micro-structures and patterns thereof are described in U.S. Patent Application Publs.: 20050039661 of Avinoam Kornblit et al. (publ'd Feb. 24, 2005), U.S. Patent Application Publ. 20040191127 of Avinoam Kornblit et al. (publ'd Sep. 30, 2004), and U.S. Patent Application Publ. 20050069458 of Marc S. Hodes et al. (publ'd Mar. 31, 2005). The above three published U.S. Patent Applications are incorporated herein in their entirety.

The device 600 of FIG. 6 further includes a droplet 620 located over the substrate 610 and the fluid-support-structures 612. In the embodiment shown, the droplet 620 is resting on a top surface of the fluid-support-structures 612. The device 600 may further include an electrical source 640 and an object 650. The substrate 610, electrical insulator 615, droplet 620, electrical source 640 and object 650 may be similar to their respective features discussed above with regard to previous FIGUREs.

As those skilled in the art would expect, at least based upon the aforementioned discussions with respect to FIGS. 1A thru 1E, FIGS. 2A thru 2D, and FIGS. 3, 4 and 5, the device 600 may be configured to oscillate the droplet 620 between the tops of the fluid-support-structures 612 and the substrate 610, when a voltage is applied between the substrate 610 and the droplet 620 using the electrical source 640 and the object 650. For example, the device 600 can be configured to move the droplet 620 vertically, such that a lower surface of the droplet 620 moves back and forth between the tops of the fluid-support-structures 612 and the substrate 610 in a repetitive manner.

Figure 7:
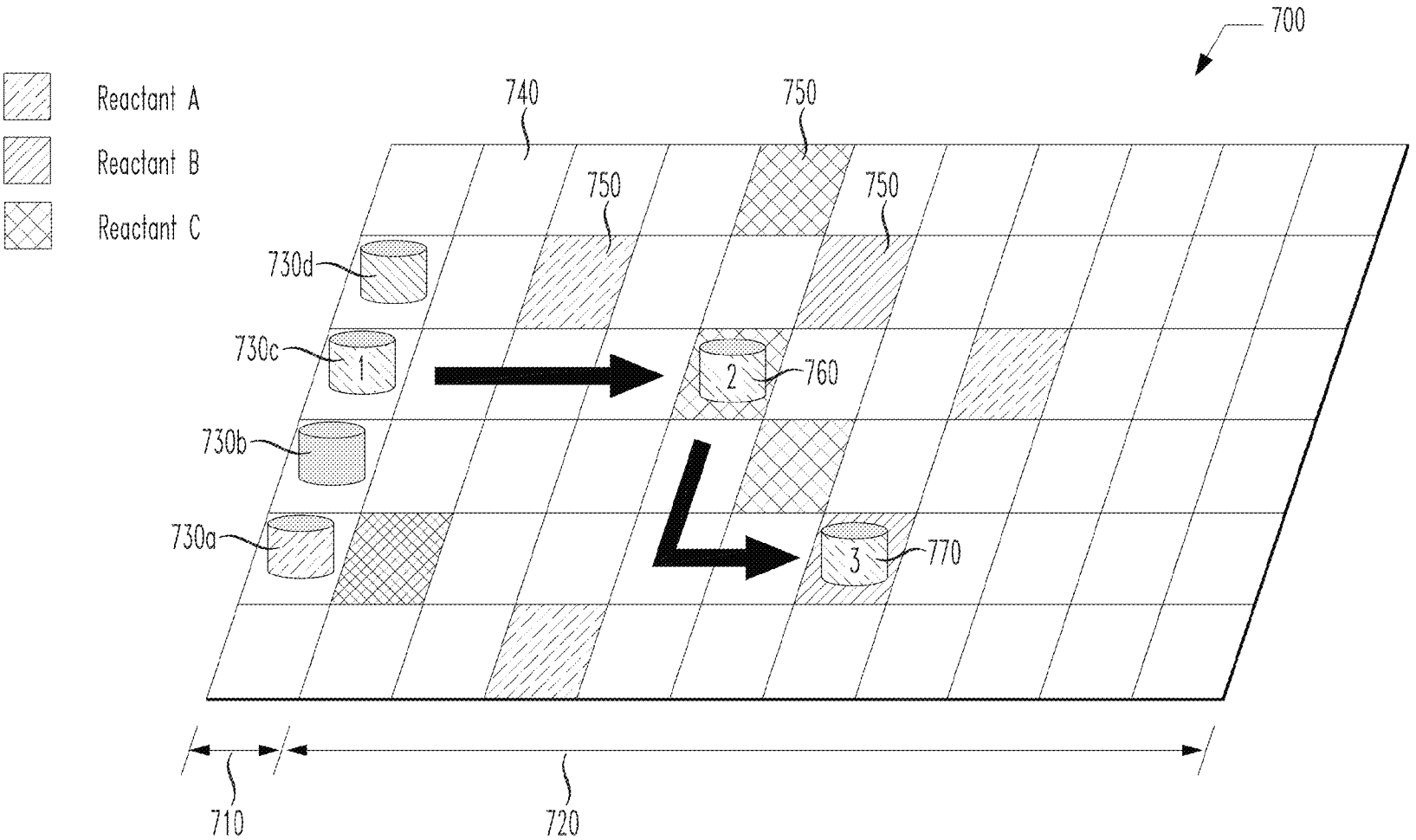
FIG. 7 illustrates one embodiment of a mobile diagnostic device in accordance with the principles of the present invention.

Based upon all of the foregoing, it should be noted that the present invention, and all of the embodiments thereof, might be used with, among others, a mobile diagnostic device such as a lab-on-chip or microfluidic device. Turning briefly to FIG. 7, illustrated is one embodiment of a mobile diagnostic device 700 in accordance with the principles of the present invention. The mobile diagnostic device 700 illustrated in FIG. 7 initially includes a sample source region 710 and a chemical analysis region 720. As is illustrated in FIG. 7, the sample source region 710 may include a plurality of droplets 730, in this instance four droplets 730*a*, 730*b*, 730*c*, and 730*d*. As is also illustrated in FIG. 7, the chemical analysis region 720 may include a plurality of both blank pixels 740 and reactant pixels 750.

The device 700 of FIG. 7, as shown, may operate by moving the droplets 730 across the chemical analysis region 720, for example using electrowetting. As the droplets 730 encounter a reactant pixel 750, a voltage may be applied across the substrate and the droplet 730, thereby causing the droplet 730 to move to a more flattened state (e.g., wetted state in certain embodiments), and thus come into contact with the reactant located within that particular reactant pixel. The reactant in the pixel may be of a liquid form or a solid form. For example, the reactant may be in a solid form, and thus dissolved or adsorbed by the droplet 730.

This process is illustrated using the droplet 730*c*. For example, the droplet 730*c* is initially located at a position 1. Thereafter, the droplet 730*c* is moved laterally using any known or hereafter discovered process wherein it undergoes an induced reaction 760 at position 2. The induced reaction 760, in this embodiment, is initiated by applying a non-zero voltage between the substrate and the droplet 730*c*, thereby causing the droplet 730*c* to move to a more flattened state, and thus come into contact with the reactant in that pixel. Thereafter, as shown, the droplet 730*c* could be moved to a position 3, wherein it undergoes another induced reaction 770.

It should be noted that while the droplets 730 are located at any particular location, the droplets 730 may be repeatedly deformed in accordance with the principles discussed above with respect to FIGS. 1A thru 1E. Accordingly, the reactant acquired during the induced reactions 760, 770, may be easily mixed using the process originally discussed above with respect to FIGS. 1A thru 1E.

In certain embodiments, each of the droplets 730 has its own object, and thus the droplets can be independently repeatedly deformed. In these embodiments, each of the objects could be coupled to an independent AC voltage supply, or alternatively to the same AC voltage supply, to induce the mixing. Each of the mentioned objects could also be configured as a needle, and thus provide additional reactant species to the drops, such as discussed above with respect to FIG. 5. Those skilled in the art understand the other ideas that might be used with the device 700.

Although the present invention has been described in detail, those skilled in the art should understand that they could make various changes, substitutions and alterations herein without departing from the spirit and scope of the invention in its broadest form.

What is claimed is:

1. A device, comprising:
a substrate;
a droplet of liquid resting on a surface of the substrate;
an electrical source electrically connected to apply a voltage between the substrate and an electrode in contact with the droplet, wherein:
the electrode has a length portion with a longitudinal axis that is normal to a plane parallel to the surface of the substrate,
the voltage applied across the droplet causes the droplet to physically deform in a direction normal to the surface of the substrate, and
the electrode further includes a second portion in contact with the droplet and shaped as a helix.

2. A device, comprising:
a substrate;
a droplet of liquid resting on a surface of the substrate;
an electrical source electrically connected to apply a voltage between the substrate and an electrode in contact with the droplet, wherein:
the electrode has a length portion with a longitudinal axis that is normal to a plane parallel to the surface of the substrate,
the voltage applied across the droplet causes the droplet to physically deform in a direction normal to the surface of the substrate, and
the electrode further includes a second portion in contact with the droplet and shaped as an inverted T.

3. A device, comprising:
a substrate;
a droplet of liquid resting on a surface of the substrate;
an electrical source electrically connected to apply a voltage between the substrate and an electrode in contact with the droplet, wherein:
the electrode has a length portion with a longitudinal axis that is normal to a plane parallel to the surface of the substrate,
the voltage applied across the droplet causes the droplet to physically deform in a direction normal to the surface of the substrate, and
the electrode further includes a second portion in contact with the droplet and shaped as an L.

4. A device, comprising:
a substrate;
a droplet of liquid resting on a surface of the substrate;
an electrical source electrically connected to apply a voltage between the substrate and an electrode in contact with the droplet, wherein:
the electrode has a length portion with a longitudinal axis that is normal to a plane parallel to the surface of the substrate,
the voltage applied across the droplet causes the droplet to physically deform in a direction normal to the surface of the substrate, and
the electrode further includes a second portion in contact with the droplet and shaped as a disk.

5. A device, comprising:
a substrate;
a droplet of liquid resting on a surface of the substrate;
an electrical source electrically connected to apply a voltage between the substrate and an electrode in contact with the droplet, wherein:
the electrode has a length portion with a longitudinal axis that is normal to a plane parallel to the surface of the substrate,
the voltage applied across the droplet causes the droplet to physically deform in a direction normal to the surface of the substrate, and
wherein the electrode further includes a second portion in contact with the droplet and shaped as a propeller.

6. A device, comprising:
a substrate;
a droplet of liquid resting on a surface of the substrate;
an electrical source electrically connected to apply a voltage between the substrate and an electrode in contact with the droplet, wherein:
the electrode has a length portion with a longitudinal axis that is normal to a plane parallel to the surface of the substrate,
the voltage applied across the droplet causes the droplet to physically deform in a direction normal to the surface of the substrate, and
the length portion of the electrode is configured as a hollow needle.

7. The device as recited in claim 6, wherein the hollow needle includes a plurality of different channels to provide different chemical species.

8. The device as recited in claim 6, wherein the substrate, the electrical source and the electrode are part of the device configured as a diagnostic device.

* * * * *